US009384670B1

(12) United States Patent
Fisher et al.

(10) Patent No.: US 9,384,670 B1
(45) Date of Patent: Jul. 5, 2016

(54) SITUATIONAL AWARENESS DISPLAY FOR UNPLANNED LANDING ZONES

(71) Applicant: The Boeing Company, Chicago, IL (US)

(72) Inventors: Robert A. Fisher, Mesa, AZ (US); Marc D. Moody, Gold Canyon, AZ (US); Judith Kristin Little, Mesa, AZ (US)

(73) Assignee: THE BOEING COMPANY, Chicago, IL (US)

( * ) Notice: Subject to any disclaimer, the term of this patent is extended or adjusted under 35 U.S.C. 154(b) by 116 days.

(21) Appl. No.: 13/965,042

(22) Filed: Aug. 12, 2013

(51) Int. Cl.
*G08G 5/00* (2006.01)
*G08G 5/02* (2006.01)

(52) U.S. Cl.
CPC ..... *G08G 5/02* (2013.01); *G08G 5/0021* (2013.01); *G08G 5/0039* (2013.01); *G08G 5/0056* (2013.01); *G08G 5/025* (2013.01)

(58) Field of Classification Search
CPC ... G08G 5/025; G08G 5/0039; G08G 5/0056; G01C 23/00; G01C 11/02
See application file for complete search history.

(56) References Cited

U.S. PATENT DOCUMENTS 7,930,097 B2 4/2011 Hess
2001/0048763 A1* 12/2001 Takatsuka et al. ..... 382/154
2002/0099528 A1* 7/2002 Hett ..... 703/13
2004/0160341 A1 8/2004 Feyereisen et al.
2004/0217883 A1* 11/2004 Judge et al. ..... 340/946
2007/0150125 A1* 6/2007 Aspen ..... 701/3
2009/0171560 A1* 7/2009 McFerran et al. ..... 701/201
2010/0100313 A1* 4/2010 Aspen ..... 701/208
2011/0264312 A1* 10/2011 Spinelli et al. ..... 701/16
2013/0046462 A1* 2/2013 Feyereisen et al. ..... 701/457
2014/0277857 A1* 9/2014 Bourret et al. ..... 701/17
2014/0343759 A1 11/2014 Garrido-Lopez et al.

OTHER PUBLICATIONS

Judd Tracy, An Approach for Computing Intervisibility Using Graphical Processing Units, University of Central Florida, 2004.*
U.S. Appl. No. 13/657,701, filed Oct. 22, 2013.
"HLZ Summary Sheet," Dept. of the Army, Fort Benning, GA (Jan. 2, 2011) http://www.benning.army.mil/tenant/wtc/content/PDF/HLZ_Handout.pdf.
"Helicopter Landing Area Selection," http://www.wildfirelessons.net/documents/6mfs_helicopterlandingareaselection.pdf.

* cited by examiner

*Primary Examiner* — Mussa A Shaawat
*Assistant Examiner* — Thomas Ingram
(74) *Attorney, Agent, or Firm* — Hanley, Flight & Zimmerman, LLC.

(57) ABSTRACT

A method for an airborne vehicle includes visually displaying a representation of an environment below the vehicle and a landing zone in the environment, computing a range of approach gates that enable the vehicle to reach the landing zone at a desired glide slope while satisfying minimum obstacle clearance, and visually displaying the range in the representation.

20 Claims, 6 Drawing Sheets

SITUATIONAL AWARENESS DISPLAY FOR UNPLANNED LANDING ZONES

BACKGROUND

Consider the example of a rotorcraft flying over terrain that does not have any planned landing zones. A change in flight conditions might require the rotorcraft to and immediately. A flight crew must quickly spot an unplanned landing zone, and lay down an approach gate that allows the rotorcraft to reach the landing zone at a desired glide slope while satisfying minimum clearance requirements.

To make these decisions, the flight crew must process a considerable amount of information very quickly. Assistance with making these quick decisions is highly desirable.

SUMMARY

According to an embodiment herein, a method for an airborne vehicle comprises visually displaying a representation of an environment below the vehicle and a landing zone in the environment, computing a range of approach gates that enable the vehicle to reach the landing zone at a desired glide slope while satisfying minimum obstacle clearance, and visually displaying the range in the representation.

According to another embodiment herein, an aircraft comprises avionics including a situational awareness display system programmed to visually display a representation of an environment below the aircraft during flight and a landing zone in the environment, compute a range of approach gates that enable the aircraft to reach the landing zone at a desired glide slope while satisfying minimum obstacle clearance, and visually display the range in the representation.

According to another embodiment herein, a situational awareness display system for an aircraft comprises a processing unit programmed to add an operator-selected landing zone to a situational awareness display, and compute a range of approach gates that enable the aircraft to reach the landing zone at a desired glide slope while satisfying minimum obstacle clearance.

According to another embodiment herein, a situational awareness display system for an aircraft comprises a processing unit programmed to create a representation of an environment including terrain below the aircraft during flight. The processing unit is further programmed to analyze ground slopes of the terrain, identify potential unplanned landing zones for the aircraft according to the ground slopes, indicate the potential unplanned landing zones in the representation, and visually display the representation.

According to another embodiment herein, aircraft avionics comprises a situational awareness display system including a processing unit programmed to continually compute and display actual glide slope of an aircraft as the aircraft approaches a landing zone from an approach gate, visually display a first cross hair indicating angular deviation of the actual glide slope from a desired glide slope, and visually display a second cross hair indicating a course deviation to the landing zone.

These features and functions may be achieved independently in various embodiments or may be combined in other embodiments. Further details of the embodiments can be seen with reference to the following description and drawings.

DETAILED DESCRIPTION

Figure 1:
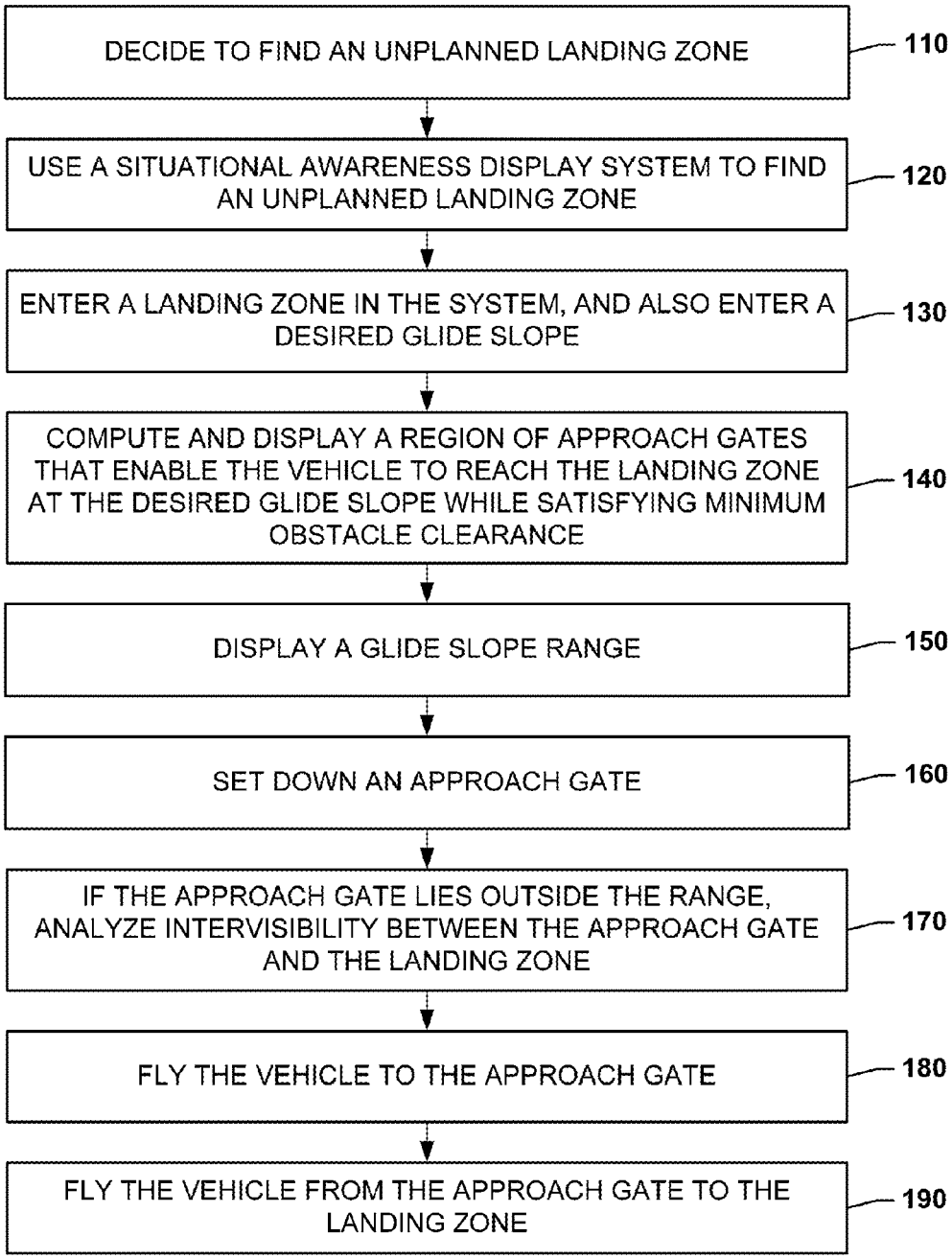
FIG. 1 is an illustration of a method for an airborne vehicle.

Reference is made to FIG. 1, which illustrates a method for an airborne vehicle. At block 110, the operator of the vehicle decides to find an unplanned landing zone. An unplanned landing zone refers to a landing zone that does not have landing infrastructure. For instance, the unplanned landing zone lacks a pad for setting down the vehicle, lights, and an instrument landing system (ILS) that provides precision guidance for the vehicle during approach and landing.

There might be a variety of reasons for deciding to find an unplanned landing zone. In some instances, a change in flight conditions might require the vehicle to and immediately. Examples of such flight conditions may include, without limitation, degraded visual environments, bad weather, mechanical failure, and low fuel. In other instances, the vehicle has to and in order to perform a mission. Examples of missions include, without limitation, firefighting, search and rescue, and military missions.

At block 120, the operator uses a situational awareness display system to find an unplanned landing zone. The situational awareness display system visually displays a representation of the environment in which the vehicle is flying. The representation of the environment may identify one or more of terrain (e.g., mountains, plateaus, open fields, lakes), man-made structures (e.g., streets, towers, buildings) and other obscurations (e.g., obscuration due to weather or battlefield conditions).

The situational awareness display system may also access certain attributes of the environment. Examples of these attributes include, without limitation, height of man-made structures and terrain, visibility of obscurations, and ground slope of open areas.

The situational awareness display system may have access to a terrain database that provides ground slope, or it may compute the ground slope. For example, it may compute the ground slope by using active sensors to analyze the shape of the terrain. This may include transforming the data from active sensors that detect the orientation of the vehicle so the data can be adjusted to an earth reference.

Knowledge of ground slope may be used to find zones for landing the vehicle. Terrain having ground slopes that support landing (that is, those areas that are flat enough to land on) may be highlighted in the representation. This information is extremely valuable, as it may not be apparent from a map or from a visual observation.

The representation may be a dynamic representation that changes with current position of the vehicle. Sources of data for the representation include, but are not limited to, terrain databases, vertical obstruction databases (e.g., databases that indicate location and height of buildings, towers, power lines and other manmade structures), moving maps, and active sensors onboard the vehicle. For examples of situational awareness display systems that make use of one or more of these sources to provide dynamic representations, see the following documents: U.S. Pat. No. 7,930,097 and U.S. Publication Nos. 20040160341, 20070150125, and 20100100313.

At block 130, the operator enters a landing zone in situational awareness display system. For instance, the system includes a touch screen monitor, and the operator taps the desired location on a map, or the operator uses a pointing device to enter the desired location. The operator may enter additional information about landing the vehicle such as a desired glide slope, minimum terrain clearance, and minimum obstacle clearance altitude. As used herein, glide slope refers to the angle from horizon from a landing zone to a location (e.g., approach gate, position of the vehicle).

At block 140, the situational awareness display system computes a range of approach gates that enable the vehicle to reach the landing zone at the desired glide slope while satisfying minimum obstacle clearance. Also at block 140, the range is visually displayed in the representation (e.g., color tinted, or indicated by radial lines extending outward from the landing zone).

Figure 2A:
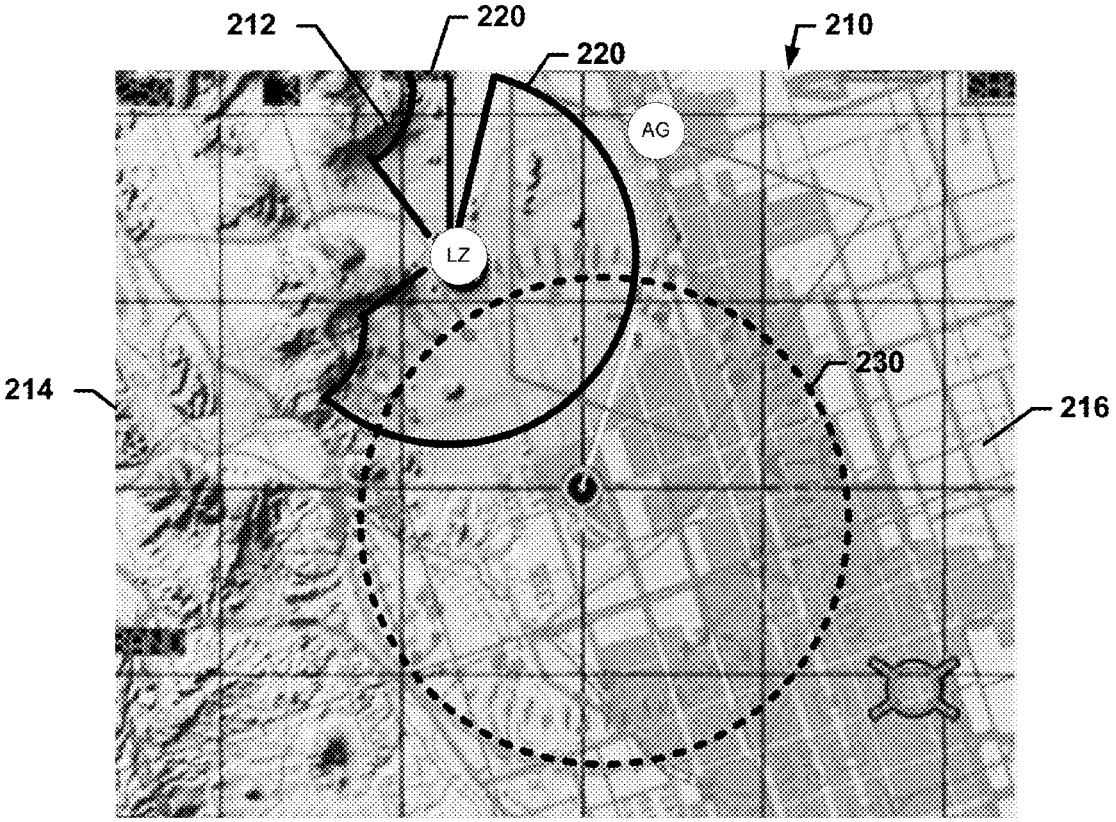
FIG. 2A is an illustration of a situational awareness display for an airborne vehicle.

Additional reference is now made to FIG. 2A, which illustrates an example of a visual representation 210. The representation 210 includes terrain that is shaded according to elevation. Mountains 212 and other terrain having a relatively dark shade area are at a higher elevation than the vehicle. Terrain 214 having a relatively light shade is at a lower elevation than the vehicle. The landing zone is designated as LZ. The regions 220 around the landing zone LZ identify a range of possible approach gates. The representation 210 also includes a map 216.

Figure 2B:
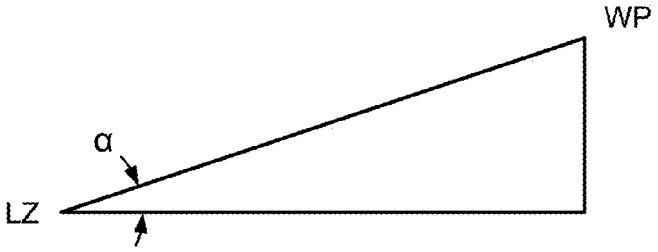
FIG. 2B is an illustration of a waypoint with respect to a landing zone.

Additional reference is now made to FIG. 2B. Candidate waypoints for the approach gate may lie along a line extending outward from in the landing zone LZ at an angle $\alpha$ equal to the desired glide slope. Intervisibility need be analyzed only between the landing zone and the farthest waypoint WP, as other waypoints lying along the line will also be acceptable candidates for approach gates.

In some embodiments, the farthest waypoint WP is a fixed distance (e.g., several nautical miles) from the landing zone LZ. This fixed distance helps to manage the computational burden of the intervisibility analysis. As the fixed distance increases, the computational burden also increases.

At block 150, the situational awareness display system may also display a range of glide slopes with respect to the current position of the vehicle. In FIG. 2A, this range is illustrated by a circle 230, which may be color coded (in practice, shape 230 might not be circular—the shape 230 may vary based on terrain and obstacle slope). All points outside the circle 230 can reach the landing zone LZ at an angle less than or equal to the desired glide slope As a result, the region outside the circle 230 indicates only those approach gates that can be reached by the vehicle from its current position without any complex maneuvers.

The glide slope projection indicated by the circle 230 improves decision making by providing the operator with an understanding of where on the terrain the split is between (1) where the vehicle would have to descend immediately and in excess of the desired glide slope to reach the landing zone LZ; and (2) where the vehicle can maintain level flight prior to descending along the desired glide slope to the landing zone LZ.

At block 160, the operator sets down an approach gate by selecting a waypoint on the representation. The approach gate need not lie within the region 220. The region 220 is merely provided as a suggestion to the operator. The operator is free to select an approach gate that lies outside the range. In FIG. 2A, the approach gate is labeled AG, and it lies outside the region 220.

At block 170, if the approach gate lies outside the range, the situational awareness display system analyzes intervisibility between the approach gate and the landing zone. The intervisibility analysis indicates whether the vehicle can arrive at the landing zone at the desired glide slope while satisfying minimum obstacle clearance. If the vehicle cannot do so, the operator is prompted to select another approach gate.

At block 180, the operator flies the vehicle to the approach gate. At block 190, the vehicle is flown from the approach gate to the landing zone. A method of flying the vehicle to an unplanned landing zone will be described in greater detail below.

The method of FIG. 1 provides information that enables a vehicle operator to select an unplanned landing zone and an approach gate. The method processes a large amount of information quickly, and puts that information into a format that can be easily digested by the operator. The formatted information improves the speed and quality of the selection. The speed and quality is especially valuable in the event of an emergency landing or a degraded visual environment.

The formatted information can also result in smoother flights to the approach gate. If the operator selects an approach gate within the suggested range, the vehicle may be flown to the selected approach gate without having to make complex maneuvers.

Figure 3:
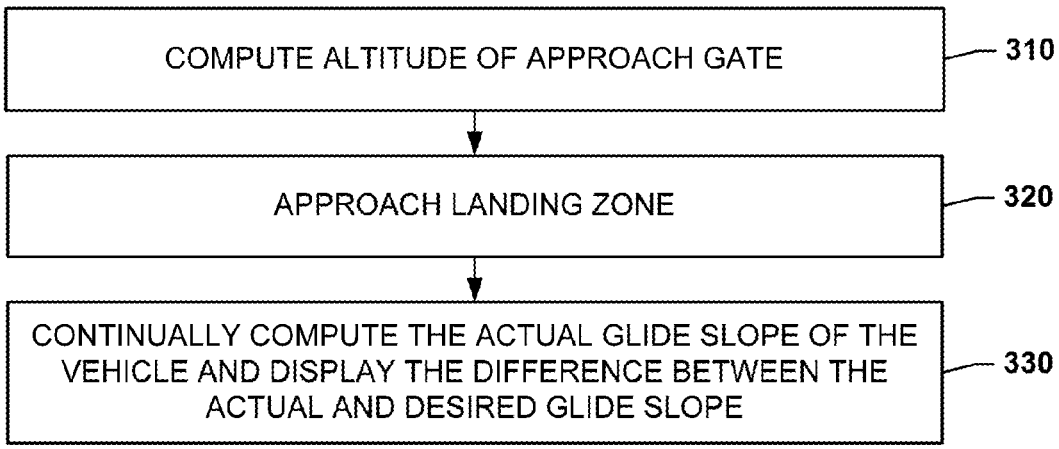
FIG. 3 is an illustration of a method for landing at an unplanned landing zone.

Reference is now made to FIG. 3, which illustrates a method for landing an airborne vehicle at an unplanned landing zone. At block 310, altitude of the approach gate is computed. The altitude may be computed by entering the desired glide slope a, computing da as the distance between the latitude and longitude locations of the landing zone and approach gate, and then computing the altitude as da*sin(a). The altitude may be computed before the vehicle arrives at the approach gate.

At block 320, the vehicle arrives at the approach gate and begins its approach towards the landing zone. The vehicle may approach the landing zone under control of the operator.

At block 330, as the vehicle approaches the landing zone, the situational awareness display system continually computes and displays the actual glide slope of the vehicle. Given the latitude and longitude of the landing zone, and the latitude and longitude of the vehicle, the actual glide slope may be computed by (1) computing dx as the difference in longitudes between the landing zone and the vehicle; (2) computing dy as the difference in latitudes between the landing zone and the vehicle; and (3) computing $a=(dx^2+dy^2)^{1/2}$; and (4) computing the actual glide slope as $\beta=\arctan(b/a)$, where b is the altitude of the vehicle.

Also at block 330, the actual glide slope may be compared against the desired glide slope and visually displayed in order to help the operator stay on course. For example, the angular deviation between the desired and actual glide slopes may be visually displayed.

Figure 4:
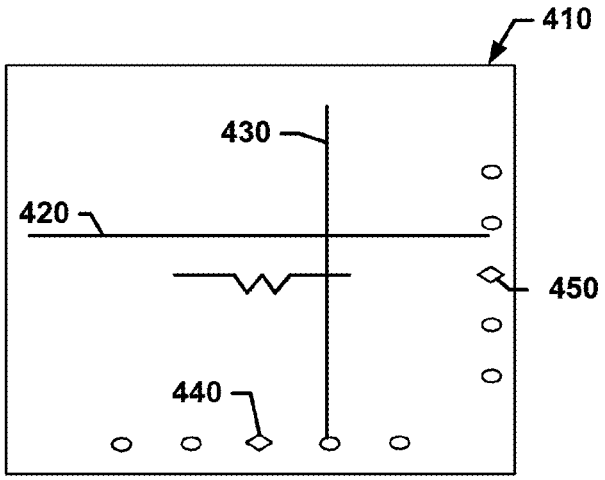
FIG. 4 is an illustration of a situational awareness display for an airborne vehicle.

FIG. 4 provides an example of a display 410 for the actual glide slope versus the desired glide slope. FIG. 4 shows a desired glide slope of 2.5 degrees and an actual glide slope of 1 degree. A horizontal cross hair 420 indicates angular deviation of the actual and desired glide slopes. A vertical cross hair 430 indicates course deviation to the landing zone. The diamond 440 corresponds to 0 degrees of course deviation. The diamond 450 corresponds to 0 degrees of glide slope deviation. The display of FIG. 4 may be side-by-side with the display of FIG. 2.

The method of FIG. 3 and the display of FIG. 4 enables the airborne vehicle to be guided to the landing zone without conventional infrastructure such as landing lights and ILS.

A method herein is not limited to any particular type of aerospace vehicle. One example is a rotorcraft or other vehicle with vertical landing capability (e.g., V/STOL aircraft). The vehicle may be manned or unmanned.

Figure 5:
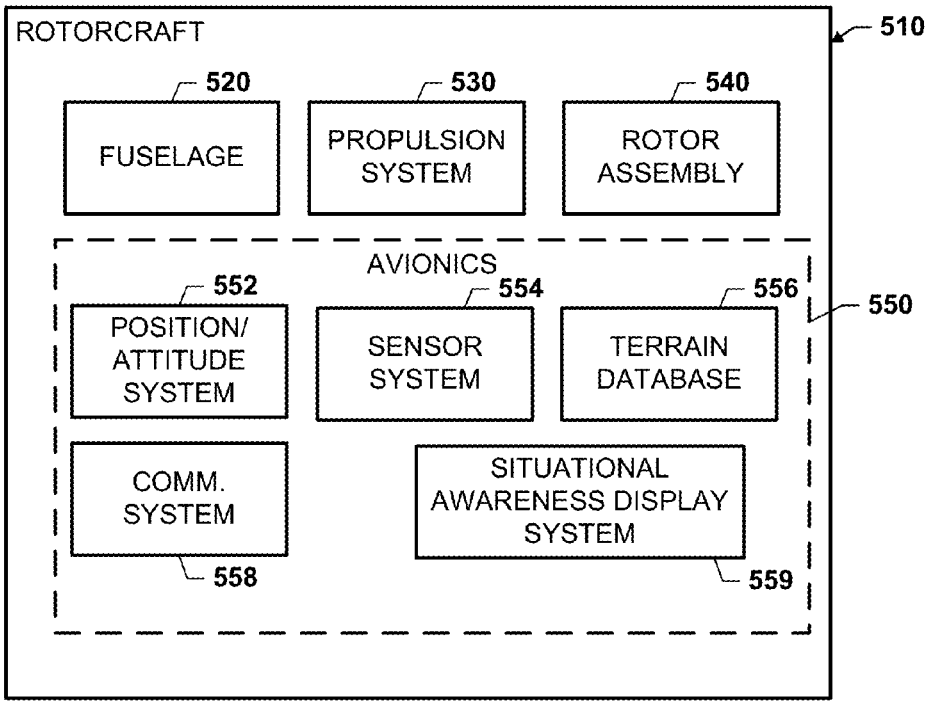
FIG. 5 is a block diagram representation of a rotorcraft.

Referring to FIG. 5, a rotorcraft 510 includes a fuselage 520, propulsion system 530, and rotor assembly 540. The fuselage 520 may house aircraft avionics 550. The avionics 550 may include a system 552 for indicating position and attitude (pitch, roll, and yaw) of the rotorcraft 510, and a sensor system 554 for providing the position of objects relative to the rotorcraft 510. For example, the sensor system 554 may include active sensors such as LIDAR or millimeter-wave radar for identifying obstacles in the environment below the rotorcraft 510.

The avionics 550 further include an onboard terrain database 556 and/or a communications system 558 for communicating with a ground-based terrain database. The terrain database 556 specifies the location and elevation of terrain, relative to a given location (e.g., the location of the rotorcraft 510), and it may also provide ground slopes of the terrain.

The avionics 550 further includes a situational awareness display system 559. The situational awareness display system 559 communicates with the terrain database 556 and sensor system 554 and displays terrain and other obstacles with respect to a reference location (e.g., the location of the rotorcraft 510); enables a landing zone to be selected and displayed; and identifies a range of candidate approach gates. Each candidate approach gate enables the rotorcraft 510 to reach the landing zone along a desired glide slope with desired minimum terrain clearance. The range may be identified by the method illustrated in FIG. 6.

Figure 8:
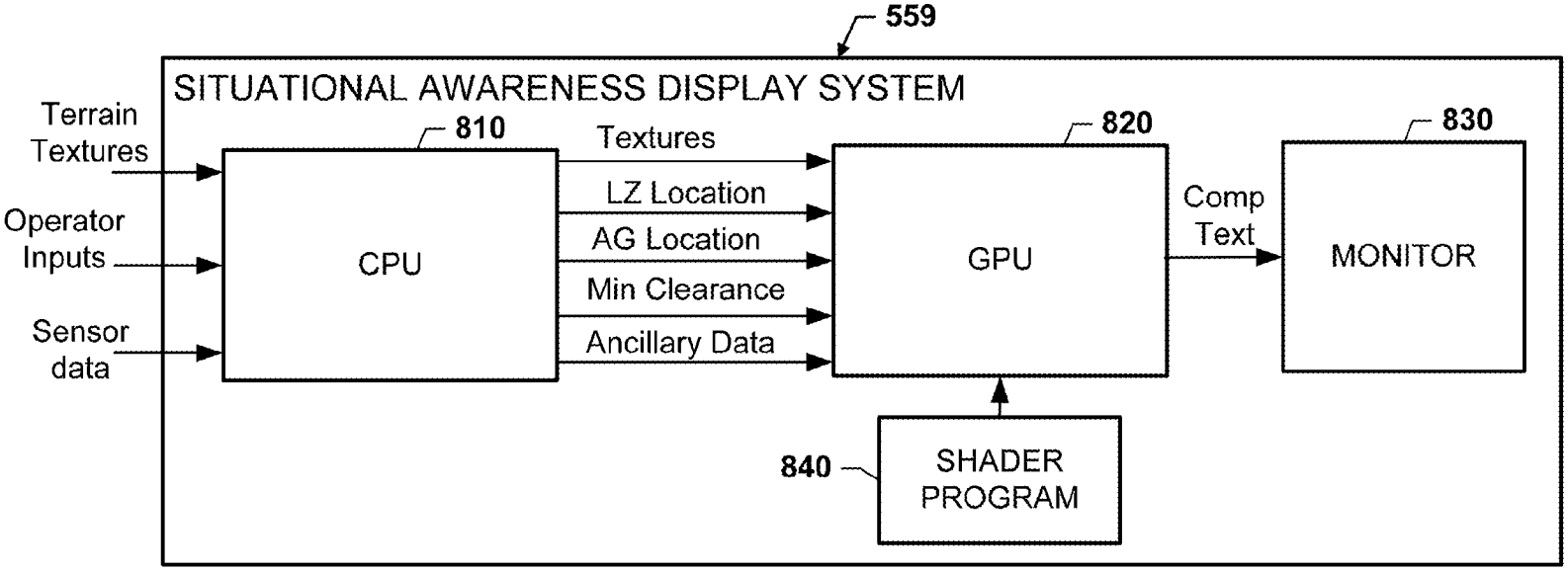
FIG. 8 is an illustration of a situational awareness display system.

The situational awareness display system 559 also enables an approach gate to be selected and displayed over the terrain. Once an approach gate is selected and the rotorcraft 510 starts its approach toward the landing zone, the system accesses the position/attitude system 552 and computes and displays the actual glide slope relative to the desired glide slope. An example of the situational awareness display 559 is illustrated in FIG. 8.

The rotorcraft 510 may be manned or unmanned. If manned, the operator may be a member of a flight crew. If unmanned, the operator may be at a remote site.

Figure 6:
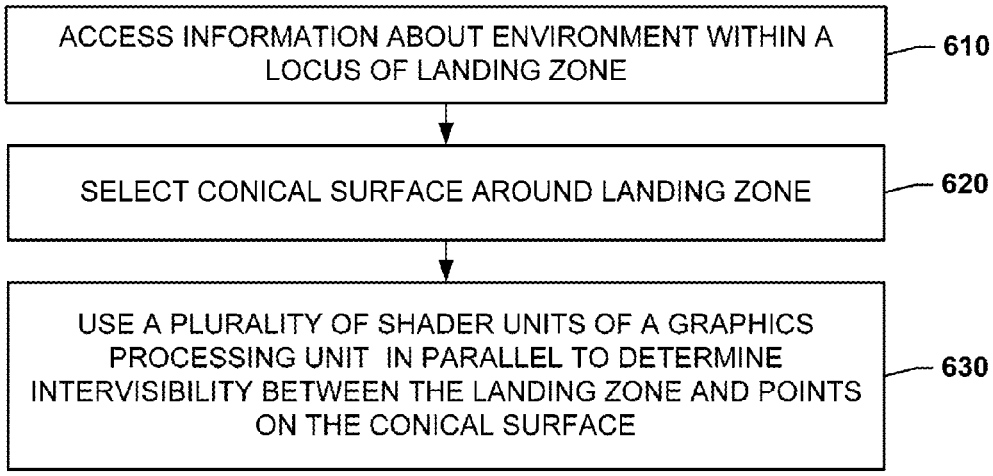
FIG. 6 is an illustration of a method for performing intervisibility analysis with respect to a landing zone.

Reference is now made to FIG. 6, which illustrates a method of performing intervsibility analysis for an environment surrounding a selected landing zone. Intervisibility refers to mutually visible sight between the landing zone and a point in the air space along a possible glide slope.

At block 610, information about the environment within a locus of the landing zone is accessed. This information may be encoded as textures that can be processed by a graphics processing unit. Textures may include numerical values representing elevation data, such as elevation data of terrain and other obstructions. The textures may be stored in the terrain database 556, and textures within the locus of the landing zone may be accessed from the terrain database 556.

At block 620, a conical surface surrounding the landing zone is identified. The surface extends outward from the landing zone at an angle equal to the desired glide slope. A perimeter of the conical surface may have the same altitude as the rotorcraft 510.

At block 630, a plurality of shader units of a graphics processing unit are used in parallel to determine intervisibility between the landing zone and all points on the conical surface. The shader units are programmed to determine whether a line of sight between a point and the landing zone satisfies minimum clearance with the terrain and any other obstacles. An output of the graphics processing unit includes a composite texture indicating those points that satisfy the line of sight to the landing zone.

Color coding may be applied to the composite texture based on those points satisfying minimum clearance. For instance, the shaded region in FIG. 2A could be tinted green, while those points not satisfying minimum clearance are transparent.

Reference is now made to FIG. 8, which illustrates an example of a situational awareness display system 559. The system 559 includes a central processing unit (CPU) 810, at least one graphics processing unit (GPU) 820, and a video monitor 830. The CPU 810 is programmed to receive data from the terrain database and the sensor system. The data from the terrain database may be in the form of textures. The data from the sensor system may be converted to texture data and combined with the textures from the terrain database.

The CPU 810 is also programmed to receive operator inputs. For example, the CPU 810 may be programmed to display a graphical user interface that enables an operator to enter inputs including, but not limited to, the desired glide scope, landing zone, and the approach gate.

The CPU 810 is further programmed to provide the textures to the GPU 820. The CPU 810 also provides the position of the landing zone when it becomes available, and it provides the approach gate when it becomes available. It also provides a minimum clearance requirement to the GPU 820. The CPU 810 may also provide ancillary data, such as color selections for depiction of the range of approach gates, elevations of terrain and obstacles greater than the elevation of the rotorcraft, and elevations of terrain and other obstacles below the elevation of the rotorcraft.

Each GPU 820 may have a number N of multiprocessors (shader units) that execute in parallel. Each multiprocessor may have a group of M stream processors or cores. Thus, the GPU 820 may have a total of N×M cores that can be executed in parallel.

Each core is assigned a group of pixels. These N×M cores enable the GPU 820 to process independent vertices and fragments in parallel.

The GPU 820 outputs a composite texture. The composite texture may be visually displayed on the monitor 830.

General-purpose computing on graphics processing units (GPGPU) enables the GPU 820 to perform computations that would otherwise be handled by the CPU 810. The GPU 820 may be programmed with a shader program 840 that causes the shader units to execute an intervisibility algorithm. A shader program in general is an executable set of instructions written in a high level programming language that is loaded on a GPU and executes on vertex and texture data sent to the GPU for visualization and computation. The shader units may also be programmed to compute color and other attributes of each pixel.

Figure 7:
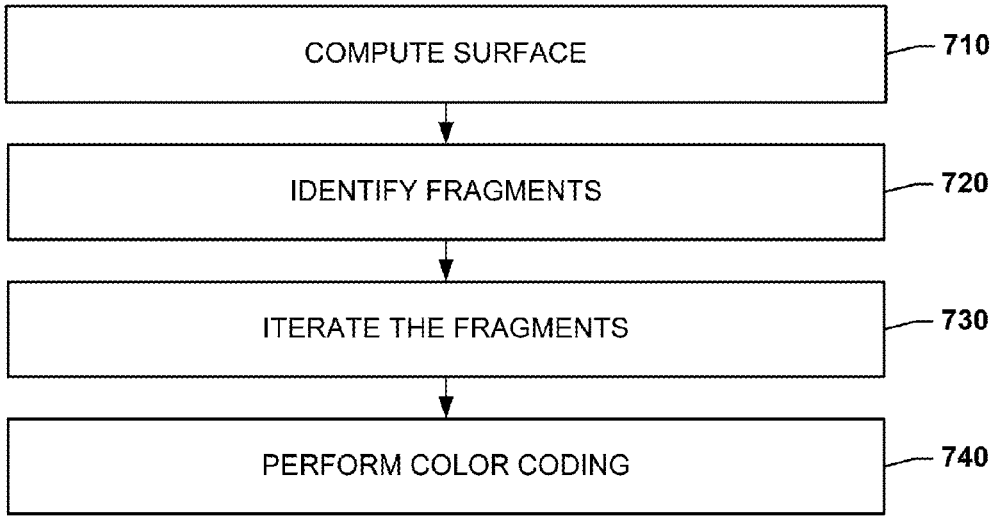
FIG. 7 is an illustration of a shader program for a graphics processor unit.

Additional reference is made to FIG. 7, which illustrates an example of a shader program 840 for determining intervisibility between the landing zone and the air space surrounding the landing zone. At block 710, the surface is computed.

At block 720, locations of fragments on the surface are identified. Each core will process a fragment to determine the color of the corresponding display pixel. As part of block 720, offsets into the input textures are derived for the fragments. These offsets enable elevation at a pixel to be determined. Distance between pixels on the elevation texture may also be determined at block 720.

Each fragment is iterated by the GPU 820 to calculate intervisibility over the entire area (block 730). Color coding may be performed (block 740). Those portions of the surface satisfying minimum clearance requirements may be tinted with a percentage transparency, whereas other areas are 100% transparent. Color coding of potential unplanned landing zones may also be performed to distinguish between areas that are flat enough to land on, and areas that are too steep.

For example, the CPU 810 provides the offset location in the texture where the landing zone is located, glide slope, minimum clearance, as well as other parameters so that measurements in texture space offsets can be scaled to meters. Each shader unit is provided with the offset it is drawing in the texture.

Each shader unit walks the line from the landing zone offset to its offset looking for any impingements. It uses the input parameters to determine the distance from its offset to the checked offset (wherever it is on its line walk). This is then used to determine the altitude for the provided glide slope given the distance from the landing zone. The glide slope altitude minus the minimum clearance is then compared to the elevation at the checked offset location.

If the offset at a shader unit is impinged, then its pixels are categorized and marked as such. For example, the pixels may be tinted (e.g., marked with red hash).

If the offset at a shader unit is not impinged, and the line walk from the landing zone offset does not reveal any impingements, then it is categorized and marked as such. For example, the pixels may be tinted (e.g., tinted green).

If the offset at a shader unit is not impinged but the line walk does reveal an impingement, then it is categorized and marked as such. For example, the pixels are made transparent.

The invention claimed is:

1. A method comprising:

displaying, via an interface associated with a processor, a representation of an environment below an airborne vehicle;

receiving, via the interface, a first input including a landing zone for the vehicle in the environment and a second input including a first glide slope at which the vehicle is to reach the landing zone;

computing, via the processor, a second glide slope based on a first position of the vehicle relative to the landing zone and a third glide slope based on the first position of the vehicle relative to the landing zone, each of the second glide slope and the third glide slope within a threshold range of the first glide slope;

identifying, via the processor, a first approach gate based on the second glide slope and a second approach gate based on the third glide slope; and displaying, via the interface, the first approach gate and the second approach gate in the representation.

2. The method of claim 1, further comprising:

displaying a range of a glide slopes in the representation, the range including the second glide slope and the third glide slope; and updating each of the glide slopes in the range based on a current position of the vehicle relative to the landing zone.

3. The method of claim 1, further comprising identifying a waypoint associated with the first approach gate, the waypoint within a fixed distance from the landing zone.

4. The method of claim 1, further comprising receiving a third input including a selection of one of the first approach gate or the second approach gate as a selected approach gate.

5. The method of claim 4, further comprising analyzing intervisibility between the selected approach gate and the landing zone.

6. The method of claim 1, further comprising:

computing a fourth glide slope based on a second position of the vehicle relative to the landing zone; and and displaying a difference between the fourth glide slope and the first glide slope.

7. The method of claim 6, wherein the second position is a current position of the vehicle relative to the landing zone and the difference is an angular deviation between the first glide slope and the fourth glide slope.

8. The method of claim 1, further comprising:

accessing the representation of the environment from a terrain database, the terrain database including elevation information;

identifying a minimum obstacle clearance for the vehicle; and determining whether the minimum obstacle clearance is satisfied based on the elevation information.

9. The method of claim 8, further comprising:

analyzing, based on the elevation information, ground slopes of the environment;

identifying potential landing zones based on the analysis; and displaying the potential landing zones in the representation.

10. The method of claim 8, wherein each of the first approach gate and the second approach gate satisfy the minimum obstacle clearance.

11. The method of claim 1, wherein the first input is received prior to the displaying of the first approach gate and the second approach gate in the representation.

12. The method of claim 1, further comprising:

identifying locations of obstacles in the environment; and displaying the obstacles in the representation.

13. The method of claim 1, wherein identifying the first approach gate includes analyzing intervisibility between the landing zone and waypoints along the second glide slope.

14. The method of claim 13, wherein determining the intervisibility is based on elevation data of a terrain of the environment and obstructions in the environment.

15. The method of claim 1, wherein the second glide slope has an angle less than or equal to an angle of the first glide slope and the third glide slope has an angle greater than or equal to the angle of the first glide slope, the respective angles of the second glide slope and the third glide slope each within the threshold range.

16. An aircraft comprising avionics, the avionics including a processor configured to:

display, via an interface associated with the processor, a representation of an environment below the aircraft during flight receive, via the interface, a first input including a landing zone for the aircraft in the environment and a second input including a first glide slope at which the aircraft is to reach the landing zone;

compute a second glide slope based on a first position of the aircraft relative to the landing zone and a third glide slope based on the first position of the aircraft relative to the landing zone, each of the second glide slope and the third glide slope within a threshold range of the first glide slope;

identify a first approach gate based on the second glide slope and a second approach gate based on the third glide slope; and display the first approach gate and the second approach gate in the representation.

17. The aircraft of claim 16, wherein the processor is configured to:

compute a fourth glide slope of the aircraft as the aircraft approaches the landing zone from one of the first approach gate or the second approach gate;

display a first cross hair indicating an angular deviation of the fourth glide slope from the first glide slope; and display a second cross hair indicating a course deviation to the landing zone.

18. A system comprising a processor, the processor configured to:

receive, via an interface associated with the processor, a first input including a selected landing zone for an aircraft in an environment below the aircraft and a second input including a first glide slope at which the aircraft is to reach the selected landing zone;

compute a second glide slope based on a first position of the aircraft relative to the selected landing zone and a third glide slope based on the first position of the aircraft relative to the selected landing zone, each of the second glide slope and the third glide slope within a threshold range of the first glide slope;

identify a first approach gate for the aircraft to reach the landing zone, the first approach gate based on the second glide slope, and a second approach gate for the aircraft to reach the selected landing zone, the second approach gate based on the third glide slope; and display the first approach gate and the second approach gate via the interface.

19. A system for an aircraft, the system comprising a processor configured to:

generate a representation of an environment including terrain below the aircraft during flight, the representation to be displayed via an interface;

analyze ground slopes of the terrain;

identify a plurality of unplanned landing zones for the aircraft based on the analysis;

display the potential unplanned landing zones in the representation;

receive, via the interface, a first input including a landing zone selected from the plurality of unplanned landing zones and a second input including a first glide slope at which the aircraft is to reach the selected landing zone;

compute a second glide slope based on a first position of the aircraft relative to the selected landing zone and a third glide slope based on the first position of the aircraft relative to the selected landing zone, each of the second glide slope and the third glide slope within a threshold range of the first glide slope;

identify a first approach gate for the aircraft to reach the landing zone, the first approach gate based on the second glide slope, and a second approach gate for the aircraft to reach the selected landing zone, the second approach gate based on the third glide slope; and display the first approach gate and the second approach gate via the interface.

20. A machine readable storage device or disc, containing instructions thereon, which, when read, cause a machine to at least:

receive, via an interface, a first input including a landing zone for an aircraft in an environment below the aircraft and a second input including a first glide slope at which the aircraft is to reach the landing zone;

compute a second glide slope based on a first position of the aircraft relative to the landing zone and a third glide slope based on the first position of the aircraft relative to the landing zone, each of the second glide slope and the third glide slope within a threshold range of the first glide slope;

identify a first approach gate for the aircraft to reach the landing zone, the first approach gate based on the second glide slope, and a second approach gate for the aircraft to reach the landing zone, the second approach gate based on the third glide slope; and display the first approach gate and the second approach gate via the interface.

* * * * *